US007509086B2

(12) United States Patent
Shirai

(10) Patent No.: US 7,509,086 B2
(45) Date of Patent: Mar. 24, 2009

(54) IMAGE FORMING APPARATUS

(75) Inventor: Masanari Shirai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/613,025

(22) Filed: Dec. 19, 2006

(65) Prior Publication Data

US 2007/0140764 A1 Jun. 21, 2007

(30) Foreign Application Priority Data

Dec. 21, 2005 (JP) ..... 2005-368250

(51) Int. Cl.
*G03G 21/10* (2006.01)

(52) U.S. Cl. ..... 399/358

(58) Field of Classification Search ..... 399/92, 399/93, 98, 91, 358, 355
See application file for complete search history.

(56) References Cited

U.S. PATENT DOCUMENTS 4,093,369 A * 6/1978 Hewitt
4,666,282 A * 5/1987 Rowe ..... 399/93
5,899,600 A * 5/1999 Hockey et al. ..... 399/93

FOREIGN PATENT DOCUMENTS

| | | |
|---|---|---|
| JP | 07-319355 | 12/1995 |
| JP | 11-204524 | 7/1999 |
| JP | 11-249522 | 9/1999 |
| JP | 2003-139790 | 5/2000 |

* cited by examiner

*Primary Examiner*—Susan S Lee
(74) *Attorney, Agent, or Firm*—Canon USA Inc I.P. Div

(57) ABSTRACT

In a toner collecting device of the cyclone separator type that collects toner separated from air, exhaust of the air including unseparated toner to outside the cyclone separator, which is caused by an unstable sucking operation of a cyclone blower, can be prevented. The toner collecting device includes a blocking unit that blocks airflow generated by the suction of the cyclone blower while the sucking operation of the cyclone blower is not in a steady state.

9 Claims, 6 Drawing Sheets

IMAGE FORMING APPARATUS

BACKGROUND OF THE INVENTION

1. Field of the Invention

The present invention relates to image forming apparatuses of the electrophotographic type. In particular, the present invention relates to toner collecting devices of the cyclone separator type that collects toner removed from image bearing members by separating and carrying the toner using swirling airflow.

2. Description of the Related Art

In image forming apparatuses of the electrophotographic type, most toner images formed on photosensitive members or transfer bodies are transferred to recording materials such as recording paper during a transferring step. However, some toner remain on the surface of the photosensitive members or the transfer bodies without being transferred.

To date, such remaining toner have been scraped off using cleaning devices including removing units such as brushes and blades, and carried to collecting boxes by toner collecting devices such as rotating screws. However, such toner collecting devices require screws for carrying the toner and driving sections for driving the screws. This leads to an increase in the size of the devices, and moreover, affects the flexibility of the structure of the image forming apparatuses.

Therefore, a toner carrying device that carries toner using an airflow generated by suction and collects the toner separated from the air using a cyclone separator as shown in FIG. 4 has been discussed in, for example, Japanese Patent Laid-Open Nos. 07-319355 and 11-249522. This toner carrying method using airflow does not require a carrying member for carrying the toner and a driving section for driving the carrying member. Moreover, since an air hose in which the air flows can be freely arranged, the flexibility of the structure of the image forming apparatus can be enhanced, and the size of the apparatus can be advantageously reduced.

Such a toner collecting device includes a cyclone blower 212 for sucking remaining toner via a carrying path (213, 216, 217) after removing the remaining toner using a cleaning member, a cyclone separator 214 collecting the toner at a predetermined position of the carrying path, a toner collecting container 215 disposed under the cyclone separator 214, and a filter 218 disposed in an air intake channel to the cyclone blower 212 or in an air exhaust channel for collecting fine particles of the toner.

The separative power of the cyclone separator 214 of this type largely depends on the wind speed of airflow generated by a suction blower for sucking the air.

In a cyclone separator system, the diameter of separable particles is determined on the basis of the diameter of a cylindrical air intake section and the wind speed of the intake air.

FIG. 2 is a graph illustrating a relationship between the minimum diameter of toner particles that are separable using a cyclone and the radius of the cyclone (radius of gyration of fluid when the fluid is rotated using the cyclone). The abscissa represents the minimum diameter of the particles separable using the cyclone, and the ordinate represents the radius of the cyclone. As shown in FIG. 2, when the radius of the cyclone is 5 cm, particles having diameters of 7 μm or smaller cannot be separated with a wind speed of 5 m/s. In order to separate particles having a diameter of 5 μm, the wind speed needs to be set to 10 m/s.

In general, it is difficult to change the diameter of the cyclone. Therefore, a wind speed higher than or equal to a predetermined level needs to be maintained in order to stably separate toner particles having diameters larger than or equal to a predetermined size. However, the suction blower in the cyclone separator generally requires a time to achieve a steady state during startup and shutdown. Accordingly, the wind speed in the sucking section of the cyclone is unstable during transition such as the startup and shutdown, and the fine particles of the toner cannot be separated as shown in FIG. 2. Thus, the toner is discharged to outside the apparatus and pollutes the exterior of the apparatus during the transition. Moreover, when a filter for collecting fine particles of toner is disposed in the air exhaust channel, excessive toner is carried to the filter, and shortens the lifetime of the filter.

In particular, when a toner collecting device of the cyclone separator type is used in an image forming apparatus, the suction blower is sometimes activated or shut down under abnormal conditions of the image forming apparatus, for example, shutdowns caused by paper jams or malfunctions.

This leads to early clogging of the filter for collecting the fine particles of the toner. Thus, an increase in costs for exchanging the filter and an increase in the size of the filter are unavoidable.

SUMMARY OF THE INVENTION

The present invention is directed to an image forming apparatus. According to one aspect of the present invention, an image forming apparatus includes an image bearing member configured to carry a toner image; a toner image forming unit configured to form the toner image on the image bearing member; a removing unit configured to remove the toner on the image bearing member; an airflow channel configured to swirl the toner removed by the removing unit and air such that the toner is separated from the air; a suction unit configured to suck the air in the airflow channel; a blocking member that blocks a connecting path between the airflow channel and the suction unit; a shifting unit operable to move the blocking member to a first position blocking the connecting path or to a second position opening the connecting path; and a control unit controlling the position of the blocking member according to an image forming signal.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

1. Image Forming Apparatus

Figure 1:
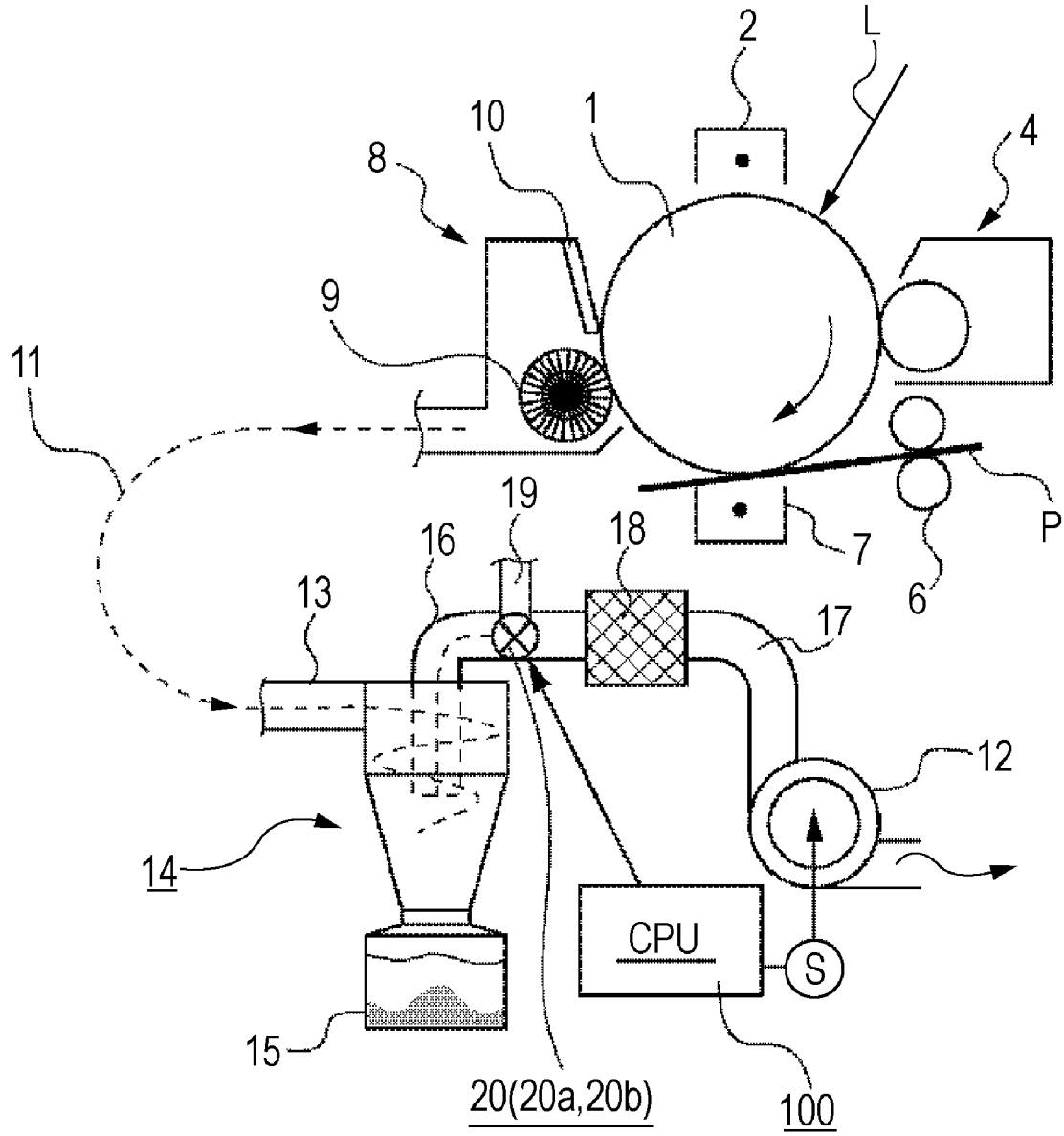
FIG. 1 is a schematic view of a toner collecting device and an image forming apparatus according to an exemplary embodiment of the present invention.
Figure 2:
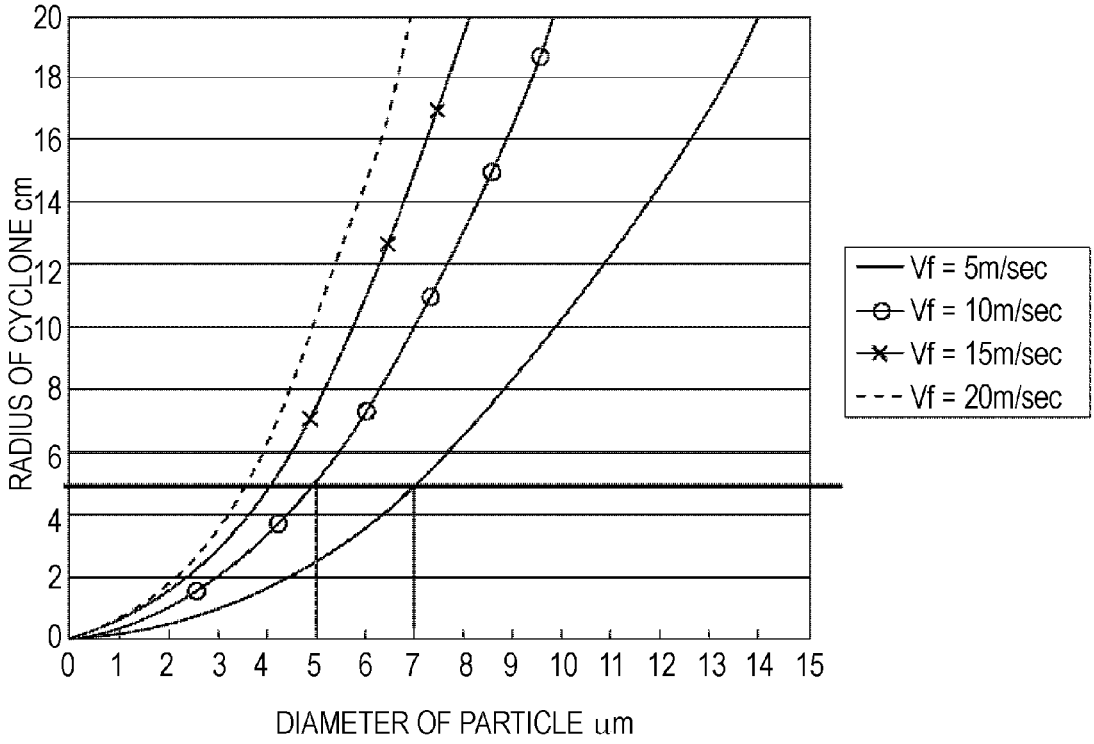
FIG. 2 illustrates a relationship between the diameter of particles and the wind speed of airflow in a cyclone separator.
Figure 6:
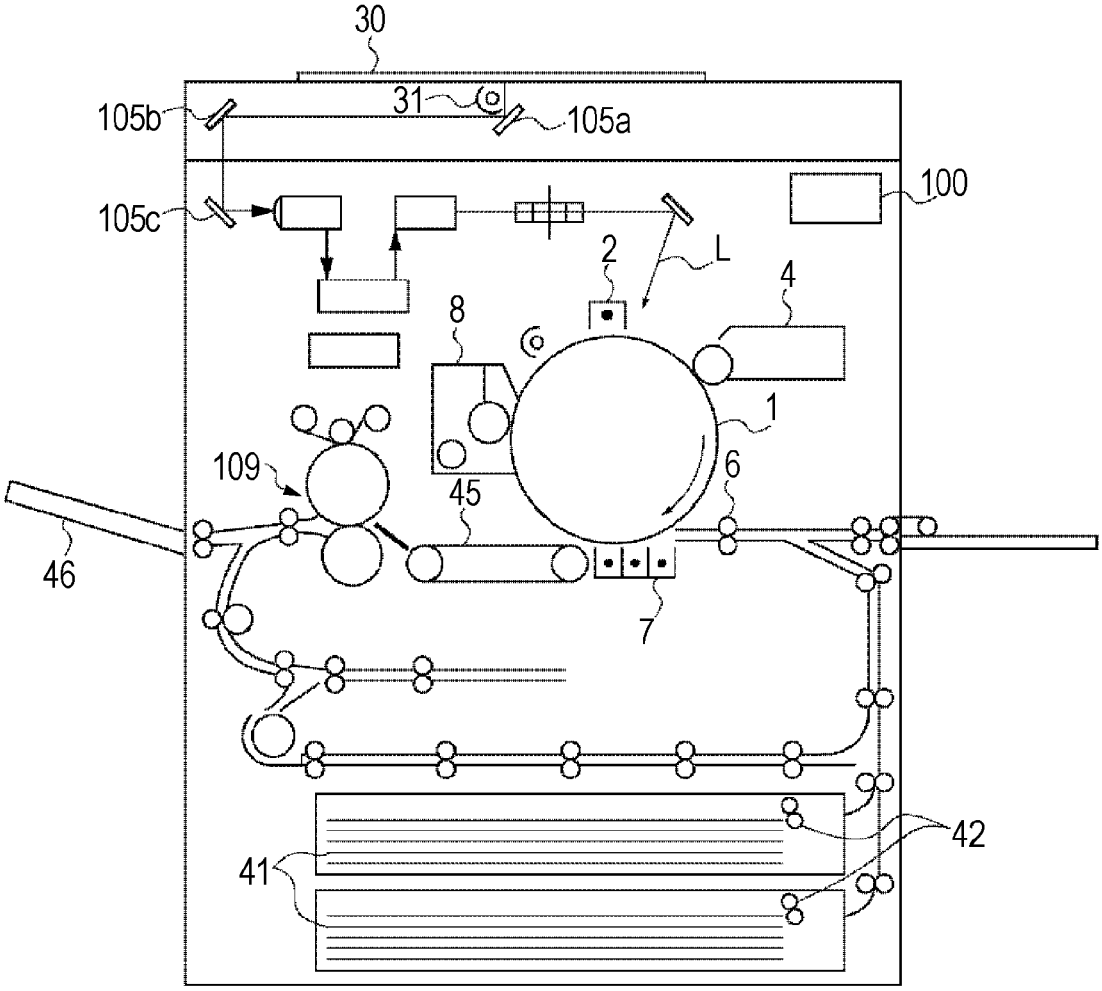
FIG. 6 is a cross-sectional view of the image forming apparatus according to the exemplary embodiment of the present invention.

FIG. 6 is a cross-sectional view of an image forming apparatus according to an exemplary embodiment of the present invention, and FIG. 1 illustrates a toner collecting device of the image forming apparatus according to an exemplary embodiment of the present invention.

An image reading mechanism for reading image information of an original document 30 serving as an information resource is disposed in the upper portion of the main body of the image forming apparatus shown in FIG. 6.

That is, light beams emitted from a light source 31 are reflected from the original document 30 placed on a platen glass (not shown) with the image surface facing downward, and then reflected at mirrors 105*a*, 105*b*, and 105*c*. The light beams are then converted into digital image signals modulated via an image reading element and a control CPU 100.

Next, laser beams L serving as the digital image signals are incident on a charged portion on the outer circumferential surface of an image bearing member 1 such that an electrostatic latent image is formed on the charged portion.

After the outer circumferential surface of the image bearing member 1 is uniformly charged using a primary charging device 2 disposed above the image bearing member 1, the laser beams L are incident on the charged potion of the outer circumferential surface such that the electrostatic latent image is formed. The electrostatic latent image is developed as a toner image using toner serving as a developer in a developing device 4.

Next, the toner image formed on the outer circumferential surface of the image bearing member 1 is transferred to a recording medium P using a charging device 7 for transfer operation, and then the recording medium P is separated from the outer circumferential surface of the image bearing member 1. The recording medium P, separated from the outer circumferential surface of the image bearing member 1, is carried to a fixing device 109 by a carrying belt 45. The recording medium P carried to the fixing device 109 is heated and pressurized in the fixing device 109 for fixing operation, and then discharged to a paper output tray 46.

The outer circumferential surface of the image bearing member 1 is cleaned, for example, by removing residual materials, using a cleaning device 8 after the transfer operation for the next electrostatic latent image formation.

On the other hand, the recording medium P composed of paper, synthetic resin, or the like (in this exemplary embodiment, the recording medium P is composed of paper) is selectively fed from detachable cassettes 41 disposed in the lower portion of the main body of the image forming apparatus using pairs of paper feeding rollers 42, and then carried to a pair of registration rollers 43 disposed further downstream in the carrying direction of the recording medium P than the pairs of paper feeding rollers 42.

The recording medium P carried to the pair of registration rollers 6 is sent to a transfer space formed between the image bearing member 1 and the charging device 7 in synchronization with the rotation of the image bearing member 1, and is subjected to the transfer operation and the fixing operation. Finally, the recording medium P is discharged to the paper output tray 46.

2. Toner Collecting Device

Next, the toner collecting device (waste toner carrying device) according to the exemplary embodiment of the present invention will be described with reference to FIG. 1. The toner collecting device according to this exemplary embodiment of the present invention collects toner by carrying and separating the toner using a cyclone method. Herein, in the cyclone method, a fluid is swirled such that fine particles are separated by using the centrifugal force of the fluid.

The toner remaining on the image bearing member 1 is scraped off by a brush roller 9 and a cleaning blade 10 in the cleaning device 8 serving as a removing unit. The scraped toner is mixed with air and sucked into a carrying pipe 11 of the air hose type serving as a toner carrying path (including a portion indicated by a dotted line in the drawing) by a suction unit that generates the airflow. The suction unit according to this exemplary embodiment is a suction fan 12 (hereinafter referred to as a cyclone blower 12) that sucks air by rotating the fan.

The sucked toner is guided from a cyclone inlet 13 to a cyclone separator 14 at a predetermined airflow speed.

The cyclone separator 14 described here is basically of a well-known type in which air including toner flowing from the cyclone inlet 13 is swirled in a conical (or cylindrical) airflow channel having an approximately circular cross section. With this, the particles of the toner are subjected to a centrifugal force, and brought into contact with the inner wall of the cylinder. The particles lose impetus, and then fall. In this manner, the toner is separated from the air. The cyclone separator 14 includes a cylindrical upper portion (having a radius of about 5 cm) having the cyclone inlet 13 in the tangential direction, and a conical lower portion having a radius that decreases toward the bottom. Furthermore, the cyclone separator 14 includes a collecting container 15 disposed under the conical portion for collecting and storing the toner. Moreover, the cyclone separator 14 includes an air hose 17 forming a carrying path (discharging path 16) that guides the air, from which the toner has been separated, from the cylindrical airflow channel to the cyclone blower 12 serving as the suction unit (described below). That is, the air hose 17 that forms the discharging path 16 has a suction port serving as an opening provided at one end of the air hose 17 for sucking the air in the cylindrical portion. Moreover, the air hose 17 has a discharge port provided at the other end of the air hose 17 for discharging the sucked air to the exterior via the cyclone blower 12. Moreover, the cyclone blower 12 includes a rotation detecting unit S serving as a detecting unit for detecting the operating state of the cyclone blower 12 by detecting the number of revolutions of the fan per unit time. The rotation detecting unit S determines whether the number of revolutions of the cyclone blower 12 per unit time is more than or equal to a predetermined level (referred to as the number of revolutions per unit time for deregulating (unblocking)). That is, the rotation detecting unit S determines whether the cyclone separator 14 is driven at a state where a predetermined sucking force (wind speed) is obtained.

Moreover, a filter 18 for collecting fine particles of toner included in the airflow after separation is disposed at a predetermined position of the air hose 17. The diameter of the toner particles in this exemplary embodiment is about 6 μm. In this exemplary embodiment, air is sucked using the cyclone blower 12 such that the speed of the air passing through the cyclone inlet 13 becomes about 10 m/s for toner separation.

Furthermore, the air hose 17 includes a branching airflow channel (guiding section) 19 disposed upstream of the filter 18 for introducing the external air into the air hose 17.

Moreover, the cyclone separator 14 includes a valve 20 serving as a controlling member for controlling the air flowing in the discharging path 16. The valve 20 is movable in the discharging path 16, and is moved to a first position for blocking the discharging path 16 and to a second position for opening the discharging path 16 using a shifting unit (not shown). This controlling member switches between the discharging path 16 and a carrying path extending from the branching airflow channel 19 to the cyclone blower 12 (hereinafter referred to as a fresh air guiding path). In this exemplary embodiment, the carrying path is switched between the discharging path 16 and the fresh air guiding path by operating only one valve 20. However, the structure is not limited to this. An air intake valve 20*a* that opens or closes the branching airflow channel 19 for introducing fresh air and a valve 20*b* that opens or closes the airflow channel in which the air after cyclone separation is directed toward the filter 18 can be separately provided. Moreover, the structure of the valve 20 is the same as those of known magnetic valves. The valve 20 according to this exemplary embodiment includes a solenoid that moves when it is energized, and a spring that urges the solenoid such that the solenoid is returned to the original position thereof when the energization is stopped. Therefore, when the valve 20 is energized by the CPU 100, the valve is moved such that the fresh air guiding path is closed and the discharging path 16 is opened. Moreover, when the energization of the valve 20 by the CPU 100 is stopped, the valve is moved such that the fresh air guiding path is opened and the discharging path 16 is closed. That is, the valve operation is controlled by controlling the energization of the valve 20 by the CPU 100.

3. Valve Operation Control for Normal Startup and Shutdown

Next, valve operation control during transition from when the rotation of the cyclone blower 12 is started in connection with the start of image formation to when the cyclone blower 12 transits to a steady rotating state will be described. The rotation of the cyclone blower 12 is detected by the rotation detecting unit S such as an encoder. When the detection results are input to the CPU 100 serving as the control unit for controlling the operation of the valve 20, the CPU 100 opens or closes the valve 20 on the basis of the detection results of the rotation detecting unit S. That is, when the rotation detecting unit S determines that the number of revolutions per unit time of the cyclone blower 12 is more than or equal to a predetermined level (the number of revolutions per unit time for unblocking), the CPU 100 operates the valve 20 such that the discharging path 16 is opened and the branching airflow channel 19 is closed. With this, the toner is separated at the cyclone separator 14, and only the air from which the toner is separated is discharged via the filter 18. When the image formation is completed and an end-of-image-formation signal is input to the CPU 100, the CPU 100 operates the valve 20 such that the discharging path 16 is closed and the branching airflow channel 19 is opened. Subsequently, the CPU 100 stops the rotation of the cyclone blower 12.

Herein, the completion of the image formation is a point in time when a predetermined time required to finish a series of image forming jobs and to collect the toner of the last original image remaining on the photosensitive member in the cyclone separator as waste toner has elapsed. In this exemplary embodiment, the completion of the image formation is measured using a timer (not shown), and the CPU 100 operates the valve 20 on the basis of the measurement results.

As described above, the valve 20 is operated such that the discharging path 16 is closed before the rotation of the cyclone blower 12 is stopped. With this, exhaust of the air including unseparated toner to outside the cyclone separator 14, which is caused by the reduction in the sucking force of the cyclone blower 12 during stopping of the rotation, can be prevented. Furthermore, the air including the toner can be prevented from flowing into the filter 18.

4. Valve Operation Control During Driving of the Cyclone Under Abnormal Conditions Next, valve operation control during stopping of image formation according to paper jams and during stopping of image formation due to the occurrence of some abnormality will be described.

When the rotation of the cyclone blower 12 is stopped due to some abnormality, the CPU 100 operates the valve 20 on the basis of the signals from the rotation detecting unit S.

That is, when the rotation detecting unit S determines that the rotational speed of the cyclone blower 12 is less than or equal to a predetermined level, the CPU 100 operates the valve 20 such that the discharging path 16 is closed and the branching airflow channel 19 is opened. With this, only the air without toner can be discharged. Thus, even when the toner is not separated from the air due to a reduction in the rotational speed of the cyclone blower 12, the air including the unseparated toner can be prevented from flowing into the filter 18.

In this manner, even when the sucking force of the cyclone blower 12 is less than a predetermined level (during transition), the air including the toner can be prevented from being discharged to the exterior. Moreover, the air including the toner can be prevented from flowing into the filter 18.

5. Timing Chart

Figure 5A:
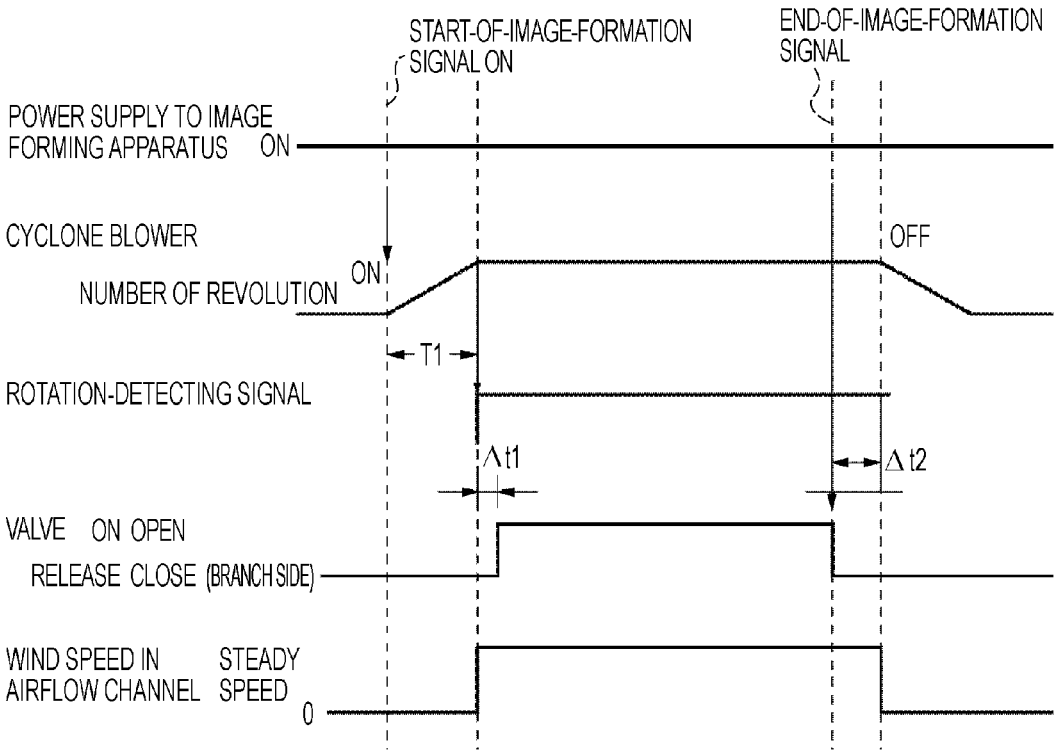
FIG. 5A is an operation timing chart in the toner collecting device according to the exemplary embodiment of the present invention during startup and shutdown of a cyclone blower.

Operations of the toner collecting device according to this exemplary embodiment will now be described with reference to a timing chart shown in FIG. 5A. FIG. 5A is a timing chart of the image forming apparatus such as a copier and a printer according to this exemplary embodiment during startup and shutdown of the toner collecting device.

First, image forming apparatuses such as copiers and printers are powered on before use, and powered off after use for reducing power consumption and as energy saving measures. Moreover, some copiers have an energy saving mode and the like for stopping supply of power except the main power supply during standby.

FIG. 5A illustrates operation timing focusing on the startup and the shutdown of the toner collecting device when the toner collecting device according to this exemplary embodiment is applied to one such image forming apparatus. Moreover, FIG. 3 is a flow chart illustrating the operation control of the valve shown in FIG. 5A.

The discharging path 16 is closed using the valve 20 before image formation signals are input to the image forming apparatus, whereas the branching airflow channel 19 is opened. The suction unit can be quickly driven to a steady rotating state by opening the branching airflow channel 19.

Figure 3:
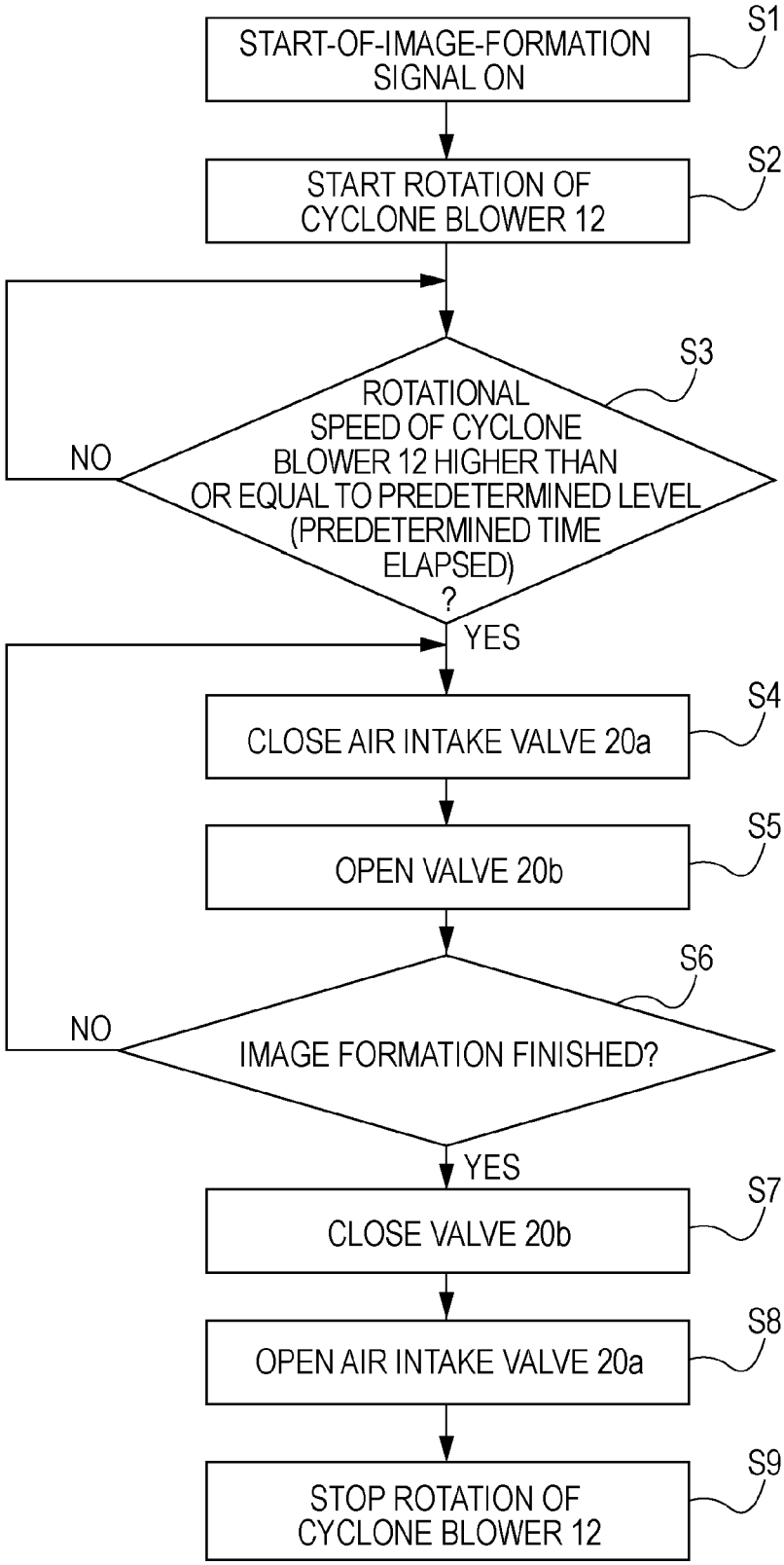
FIG. 3 is a flow chart illustrating operation timing of the toner collecting device according to the exemplary embodiment of the present invention.
Figure 4:
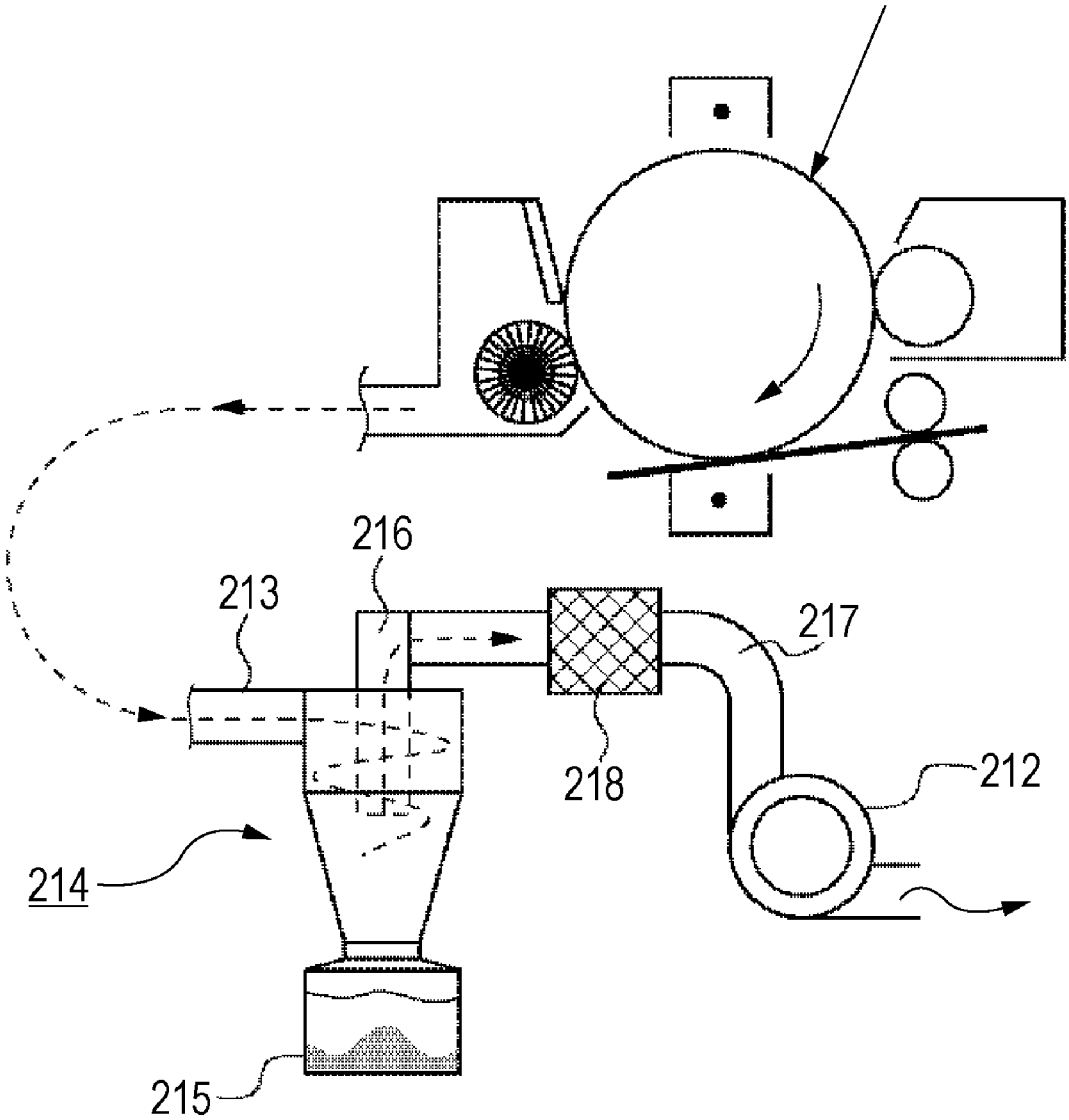
FIG. 4 PRIOR ART
FIG. 4 is a schematic view of a known toner collecting device.

When a start-of-image-formation signal is input to the CPU 100 as shown in FIGS. 3 and 5A (Step S1), the CPU 100, which serves as a control unit for controlling the drive of the cyclone blower 12, starts the rotation of the cyclone blower 12 on the basis of this signal (Step S2). The cyclone blower 12 uses a suction fan or the like driven by a DC motor, and requires a warmup time (T1 in the drawing) between when the rotation is started and when a predetermined sucking force is achieved according to the volume of the suction path. In this exemplary embodiment, the warmup time T1 is referred to as a stable driving warmup time.

Next, the rotation detecting unit S determines whether the cyclone blower 12 is rotated at a predetermined rotational speed. The CPU 100, which also serves as a control unit for controlling the opening and closing operations of the valve, operates the valve 20 on the basis of the determination results after a predetermined time (Δt1) has elapsed. The predetermined time can be adjusted according to the volume of the suction path in which the toner is carried.

Herein, a case in which an air intake valve 20*a* that opens or closes the branching airflow channel 19 for introducing fresh air and a valve 20*b* that opens or closes the airflow channel 16 are separately provided instead of the valve 20 will be described. Specifically, the CPU 100 closes the air intake valve 20*a* when the CPU 100 receives an ON signal output from the rotation detecting unit S when the cyclone blower 12 is rotated at a predetermined rotational speed (Step S4), and then opens the valve 20*b* (Step S5). The valve 20*b* is opened after the air intake valve 20*a* is closed in this exemplary embodiment. However, these operations can be performed at the same time. Moreover, the air intake valve 20*a* can be closed after the valve 20*b* is opened.

Next, the CPU 100 receives an end-of-image-formation signal for stopping the drive of the cyclone blower 12 (Step S6). After Step S6, the CPU 100 closes the valve 20*b* (Step S7), and subsequently, opens the air intake valve 20*a* (Step S8). When a predetermined time Δt2 has elapsed after Step S8, the CPU 100 stops the rotation of the cyclone blower 12 (Step S9).

In this manner, the airflow channel of the discharging path 16 can be closed before the rotational speed (the number of revolutions per unit time) of the fan of the cyclone blower 12 becomes less than or equal to a predetermined level (the number of revolutions per unit time for unblocking) in response to the end-of-image-formation signal output from the main body of the image forming apparatus. Therefore, the air including unseparated toner can be prevented from flowing into the filter 18 or being discharged to the exterior.

Moreover, when the CPU 100 receives a signal output when the number of revolutions per unit time of the cyclone blower 12 is less than the predetermined level (abnormal driving signal) instead of the end-of-image-formation signal in Step S6, the CPU 100 stops the image formation, and the process proceeds to Step S7. On the other hand, when the CPU 100 receives a signal indicating that the number of revolutions of the cyclone blower 12 per unit time is more than the predetermined level, the image formation is continued.

According to the above-described valve operation control, the wind speeds in the cyclone separator and the airflow channel are not affected by instability of the cyclone blower 12 during startup. Moreover, a predetermined wind speed can be obtained only when the sucking state of the cyclone blower 12 is sufficiently stabilized. That is, the toner is separated only when the cyclone blower 12 is in a steady rotating state. In this exemplary embodiment, the driving state of the cyclone blower 12 is directly detected using the rotation detecting unit, and the valve is operated on the basis of the detection results. However, the present invention is not limited to this. For example, without using the rotation detecting unit, the valve can be operated after a driving time determined in advance has elapsed, the driving time being that required by the cyclone blower 12 to achieve a sucking force that is more than or equal to a predetermined level after the cyclone blower 12 is activated (stable driving warmup time).

6. Valve Operation for Abrupt Power Cutoff

Figure 5B:
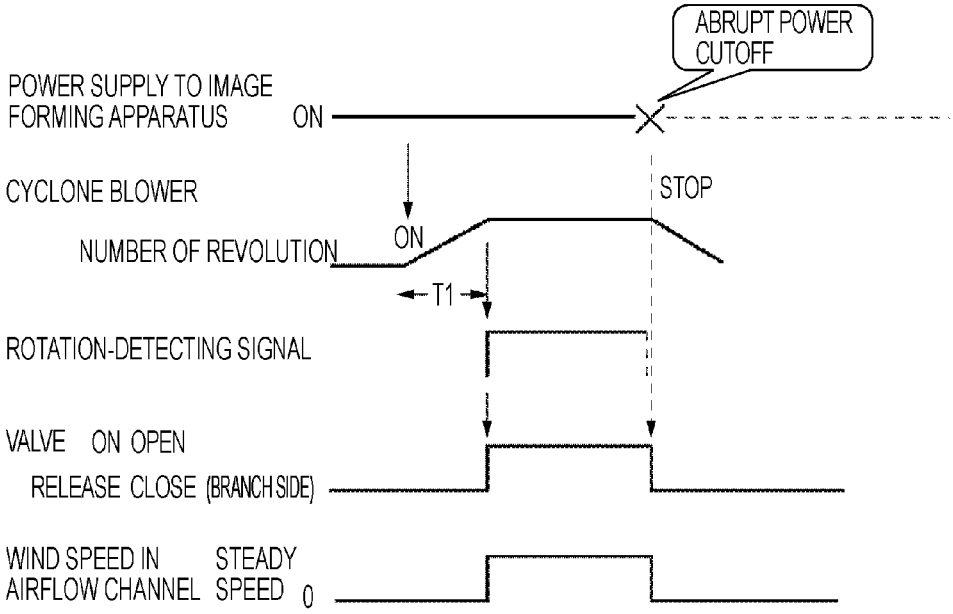
FIG. 5B is an operation timing chart in the toner collecting device during abrupt power cutoff.

Operations during abrupt power cutoff of the image forming apparatus according to this exemplary embodiment due to the occurrence of some abnormality will now be described with reference to FIG. 5B.

Power supply to the main body of an image forming apparatus such as a copier is sometimes cut off due to paper jams or malfunctions.

When the power supply to the main body of the image forming apparatus is abruptly cut off as described above, power supply to the cyclone blower 12, the rotation detecting unit, and the valve 20 is also cut off at the same time in the toner collecting device according to this exemplary embodiment unlike the shutdown in response to the above-described stopping signals (end-of-image-formation signal and abnormal driving signal). However, according to the structure in this exemplary embodiment, the valve 20 is automatically operated using the urging force of a spring or the like so as to open the branching channel and close the discharging path 16 regardless of the rotation of the cyclone blower.

Thus, the cyclone separator and the airflow channel are closed, and the air including toner can be prevented from flowing into the filter 18 or being discharged to the exterior.

As described above, the toner collecting device according to the exemplary embodiments of the present invention can prevent the air including toner from being discharged to the exterior by regulating the air while the cyclone blower in the cyclone separator is not under a steady state (under an unstable state). Moreover, the air including toner can be prevented from being discharged to the exterior in the same manner during power-on or power-off of the image forming apparatus, and furthermore, during abrupt power cutoff of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2005-368250 filed Dec. 21, 2005, which is hereby incorporated by reference herein in its entirety.

What is claimed is:

1. An image forming apparatus comprising:

an image bearing member configured to carry a toner image;

a toner image forming unit configured to form the toner image on the image bearing member;

a removing unit configured to remove the toner on the image bearing member;

an airflow channel configured to swirl the toner removed by the removing unit and air such that the toner is separated from the air;

a suction unit configured to suck the air in the airflow channel;

a blocking member that blocks a connecting path between the airflow channel and the suction unit;

a shifting unit operable to move the blocking member to a first position blocking the connecting path or to a second position opening the connecting path; and a control unit controlling the position of the blocking member according to an image forming signal.

2. The image forming apparatus according to claim 1, wherein the control unit controls the shifting unit to move the blocking member to the second position after a predetermined stable driving time has elapsed, the stable driving time being that required to stabilize the drive of the suction unit after starting actuation of the suction unit.

3. The image forming apparatus according to claim 1, further comprising:

a detecting unit configured to detect an operating state of the suction unit, wherein the control unit controls the position of the blocking member on the basis of a detection result of the detecting unit.

4. The image forming apparatus according to claim 3, wherein the suction unit includes a fan configured to suck the air in the airflow channel, and the detecting unit detects a number of revolutions of the fan per unit time.

5. The image forming apparatus according to claim 4, wherein the control unit controls the shifting unit to move the blocking member to the second position when the detecting unit determines that the number of revolutions of the suction unit per unit time is more than or equal to a number of revolutions per unit time for unblocking during driving of the suction unit, and wherein the control unit controls the shifting unit to move the blocking member to the first position when the number of revolutions per unit time is less than the number of revolutions per unit time for unblocking.

6. The image forming apparatus according to claim 1, wherein the control unit controls the shifting unit to move the blocking member to the first position in response to a signal for stopping the suction unit before stopping the drive of the suction unit.

7. The image forming apparatus according to claim 1, further comprising:

a guiding section disposed downstream of the blocking member and upstream of the suction unit in the connecting path with respect to a sucking direction of the suction unit, to the guiding section guiding air from outside into the connecting path; and an operating unit opening or closing the guiding section, wherein the control unit controls the operation of the operating unit on the basis of the drive of the suction unit.

8. The image forming apparatus according to claim 7, wherein the control unit controls the operation of the operating unit such that the guiding section is closed after a predetermined stable driving time has elapsed, the stable driving time being that required to stabilize the drive of the suction unit after starting actuation of the suction unit.

9. The image forming apparatus according to claim 8, wherein the control unit controls the shifting unit to move the blocking member to the second position after the guiding section is closed by the operating unit.

* * * * *